US007905118B2

(12) United States Patent
Regenstein et al.

(10) Patent No.: US 7,905,118 B2
(45) Date of Patent: Mar. 15, 2011

(54) METHOD OF FABRICATING TEXTILES

(75) Inventors: Markus Regenstein, Paderborn (DE); Nadja Svidskaia, Paderborn (DE)

(73) Assignee: Penn Textile Soultions, GmbH, Paderborn (DE)

( * ) Notice: Subject to any disclaimer, the term of this patent is extended or adjusted under 35 U.S.C. 154(b) by 0 days.

(21) Appl. No.: 12/452,307

(22) PCT Filed: Jul. 4, 2007

(86) PCT No.: PCT/EP2007/005912

§ 371 (c)(1), (2), (4) Date: Mar. 24, 2010

(87) PCT Pub. No.: WO2009/003504

PCT Pub. Date: Jan. 8, 2009

(65) Prior Publication Data

US 2010/0180642 A1 Jul. 22, 2010

(51) Int. Cl.
*D04B 21/06* (2006.01)

(52) U.S. Cl. ..... 66/195

(58) Field of Classification Search ..... 66/192, 66/193, 195, 172 E, 85 R, 84 R
See application file for complete search history.

(56) References Cited

U.S. PATENT DOCUMENTS

| | | | | |
|---|---|---|---|---|
| 3,590,603 | A * | 7/1971 | Jackson | 66/147 |
| 3,708,836 | A * | 1/1973 | Frolich et al. | 24/393 |
| 4,601,940 | A | 7/1986 | Fischer | |
| 4,688,403 | A * | 8/1987 | Gajjar | 66/195 |
| 4,802,346 | A | 2/1989 | Gajjar | |
| 5,029,457 | A * | 7/1991 | Gajjar | 66/195 |
| 5,706,677 | A * | 1/1998 | Matsuda | 66/192 |
| 7,181,933 | B2 * | 2/2007 | Callaway et al. | 66/193 |
| 7,555,922 | B1 * | 7/2009 | Berlin | 66/195 |

FOREIGN PATENT DOCUMENTS

| | | |
|---|---|---|
| DE | 32 33 793 A1 | 3/1984 |
| EP | 0 322 190 A1 | 6/1989 |
| GB | 2 070 656 A | 9/1981 |

* cited by examiner

*Primary Examiner* — Danny Worrell
(74) *Attorney, Agent, or Firm* — Marshall & Melhorn, LLC

(57) ABSTRACT

The invention describes a method of fabricating textile, comprising the steps of preparing a first plurality of cotton yarns, preparing a second plurality of non-cotton yarns, said first plurality of cotton yarns and said second plurality of non-cotton yarn forming warp threads of a fabric blank, warp knitting said fabric blank, characterized in that a proportion of cotton yarns is at least 65% by weight; and is characterized by forming a border of said fabric blank by intermeshing at least part of said first plurality of cotton yarns.

4 Claims, 1 Drawing Sheet

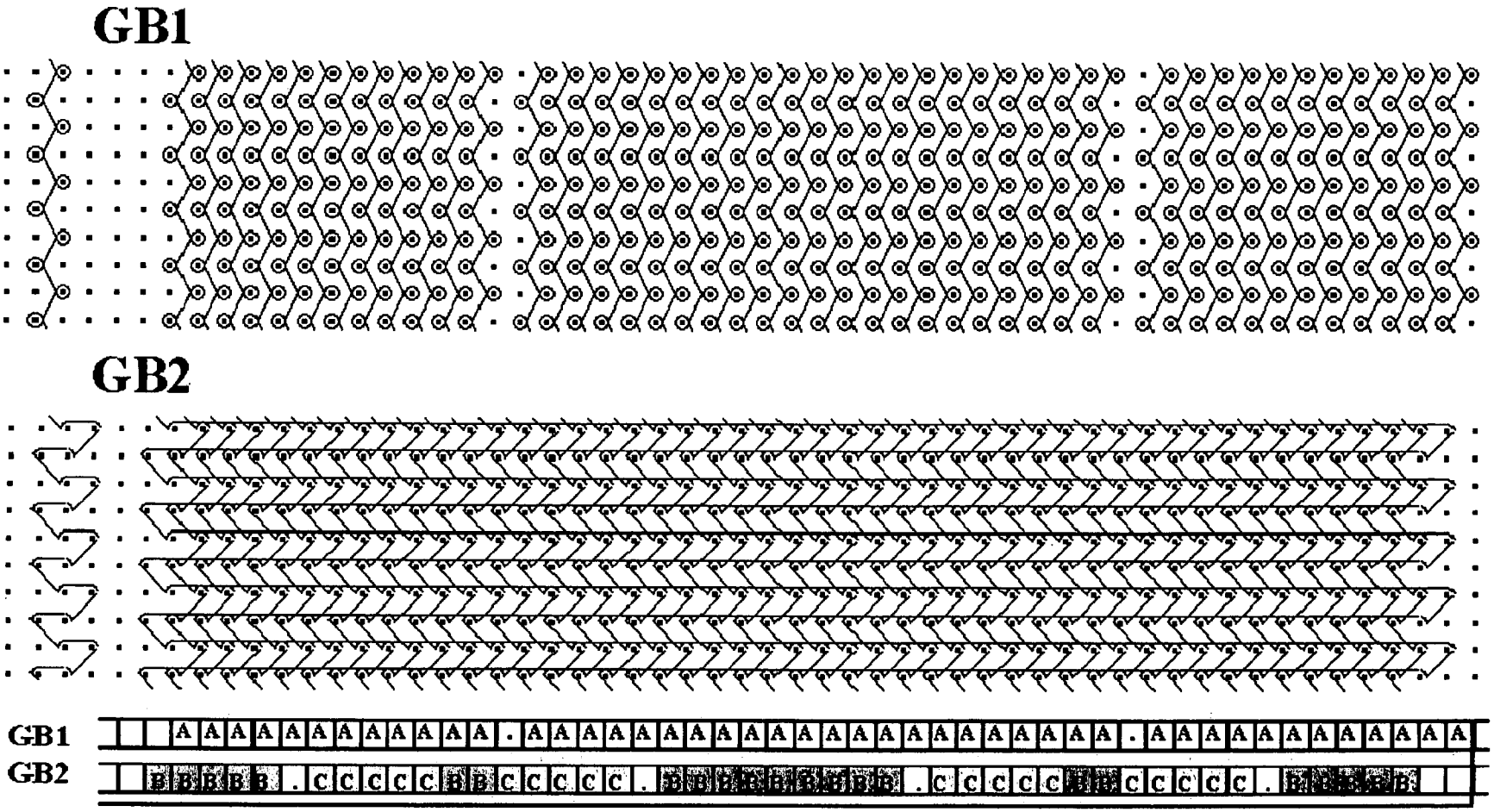
GB1
GB2
GB1
GB2

METHOD OF FABRICATING TEXTILES

BACKGROUND OF THE INVENTION

The invention relates to a method of fabricating textiles, in particular apparel and clothing articles, garment and the like.

For those textiles, cotton is a desirable component. Cotton is a natural fiber which is very breathable, hard-wearing, tearproof and resistant against heat. Further, cotton may absorb moisture in an amount of about 20% of its net weight without having a wet feeling. The absorptivity is enhanced by special treatment, for example mercerizing. Often, the natural fiber cotton is combined with an elastic synthetic fiber. The result is a textile having optimum adaptivity to a body. An elastic synthetic fiber which is known for its exceptional stretchability is elastane which has the additional advantage of being resistant to body oils, perspiration lotions and detergents, and which causes no static or pilling problems. Elastane is also known as Spandex.

Textiles made of cotton and elastane are normally knitted on a circular knitting machine, a technique that does allow that a high proportion of cotton is used. On Raschel machines, the content of cotton is normally limited to up to 35%.

GB 2070656 A refers to a method for producing knitted, longitudinally elastic fabrics, and fabrics made thereby, the method comprising the steps of preparing a first plurality of cotton yarns, preparing a second plurality of non-cotton yarns, with said first plurality of cotton yarns and said second plurality of non-cotton yarns forming warp threads for knitting a fabric blank. Said fabric blank is warp knitted such that a proportion of cotton yarns is at least 65% by weight, wherein a selvedge of said fabric blank is formed by intermeshing at least part of said first plurality of cotton yarns.

EP 0 322 290 A1 discloses a method of warp knitting and illustrates the use of koeper or twill stitches in two bar or three bar warp knitted fabrics, wherein for warp-knitted fabrics having a two-course repeat pattern of alternating first and second bar yarns, the fabric being prepared by interlocking the first and second bar yarns using a combination of knit and laid-in stitches in opposite fashion.

BRIEF SUMMARY OF THE INVENTION

The problem underlying the invention is to provide a method of fabricating textiles which allows that the proportion of cotton is considerably increased, and that a curl-free selvedge is added.

This problem is solved by a method of fabricating textiles, comprising the steps of preparing a first plurality of cotton yarns, preparing a second plurality of non-cotton yarns, said first plurality of cotton yarn and said second plurality of non-cotton yarns forming warp threads of a fabric blank, and warp knitting said fabric blank. A proportion of cotton yarns is at least 65% by weight. The method further comprises forming a border of said fabric blank by intermeshing at least part of said first plurality of cotton yarns.

It has surprisingly been found that by utilizing a multi-thread warp knitting technique, much higher proportions of cotton yarns are possible, as compared to the prior art.

By having these high proportions of cotton, it is for the first time possible to produce a very firm selvedge which does not curl up when pulled using knitting process itself. In the prior art, textiles having high proportions of cotton had to be provided with a strip or tape which is sewn with the selvedge of the fabric blank. This additional step is avoided with the present invention.

In a preferred embodiment, said non-cotton yarns comprise elastic synthetic fibers, such as elastane.

The fabric blanks or textiles may be used to produce athletic, aerobic or exercise apparel, underwear and the like.

BRIEF DESCRIPTION OF THE DRAWING

In the following, an embodiment of the invention will be described with reference to the single FIGURE which is a graphic representation of the drawing-in for warp-knitting the fabric blank.

DETAILED DESCRIPTION OF THE INVENTION

The FIGURE shows a cotton panel with two zones which is laid down with a pattern repeat length of 2. In particular,

GB1: 1-2/1-0//

GB2: 3-1/0-2//.

The drawing-in of warp threads has a pattern repeat width of 53, and in particular,

GB1:

A....AAAAAAAAAAAA.AAAAAAAAAAAAAAAA AAAAAA. AAAAAAAAAAAA

GB2: C...BBBBBDCCCCCBBCCCCCDBBBBBBBBB DCCCCCBBCC CCCDBBBBB..

wherein "." means void, i.e. no thread; and A, B, C, or D means a material of type A, type B, type C, or type D. Specifically, A is cotton, B is elastane, C is elastane, and D is elastane.

The features disclosed in the foregoing description, in the claims and/or in the accompanying drawings may, both separately and in any combination thereof, be material for realising the invention in diverse forms thereof.

The invention claimed is:

1. A method of fabricating textile, comprising the steps of:

preparing a first plurality of cotton yarns;

preparing a second plurality of non-cotton yarns; said first plurality of cotton yarns and said second plurality of non-cotton yarns forming warp thread for knitting of a fabric blank;

warp knitting said fabric blanks;

forming a selvedge of said fabric blank by intermeshing at least part of said first plurality of cotton yarns; said selvedge having two zones, with a pattern repeat length of 2, with the ground guide bars GB1 and GB2 being GB1: 1-2/1-0// and GB2: 3-1/0-2//; wherein said selvedge has a pattern repeat width of 53, and GB1: A....AAAAAAAAAAAA.AAAAAAAAAAAAAAAA AAAAAAA.AAAAAAAAAAAAGB2: C...BBBBB DCCCCCBBCCCCCDBBBB BBBBBDCCCCCBBC-CCCCDBBB BB.. wherein "." means void, i.e., no thread; A means a cotton yarn, B means a first non-cotton yarn, C means a second non-cotton yarn, and D means a third non-cotton yarn.

2. The method of claim 1, wherein said non-cotton yarns B, C and D comprise elastic synthetic fibers.

3. The method of claim 1, wherein said non-cotton yarns B, C and D are elastane.

4. The method of claim 1, wherein the proportion of cotton yarns in said warp thread is at least 65% by weight.

* * * * *